US007998096B1

(12) United States Patent
Skoog

(10) Patent No.: US 7,998,096 B1
(45) Date of Patent: Aug. 16, 2011

(54) PARAPLEGIC CONTROLLED, CONCEALED MECHANIZED WALKING DEVICE

(76) Inventor: Eric J. Skoog, Grand Junction, CO (US)

( * ) Notice: Subject to any disclaimer, the term of this patent is extended or adjusted under 35 U.S.C. 154(b) by 1064 days.

(21) Appl. No.: 11/732,825

(22) Filed: Jun. 25, 2007

(51) Int. Cl.
*A61H 1/00* (2006.01)
*A61H 3/00* (2006.01)
*A61H 3/02* (2006.01)

(52) U.S. Cl. ..... 601/5; 601/35

(58) Field of Classification Search ..... 601/5, 23, 601/33–36; 600/595; 602/16, 23
See application file for complete search history.

(56) References Cited

U.S. PATENT DOCUMENTS 4,697,808 A * 10/1987 Larson et al. ..... 482/51
7,278,954 B2 * 10/2007 Kawai et al. ..... 482/1
7,524,297 B2 * 4/2009 Shimada et al. ..... 602/16
7,549,969 B2 * 6/2009 van den Bogert ..... 602/16
2006/0149338 A1 * 7/2006 Flaherty et al. ..... 607/49
2007/0027409 A1 * 2/2007 Katoh et al. ..... 601/5
2007/0256718 A1 * 11/2007 Diaz ..... 135/72
2008/0039756 A1 * 2/2008 Thorsteinsson et al. ..... 602/23
2008/0097269 A1 * 4/2008 Weinberg et al. ..... 602/16
2008/0154165 A1 * 6/2008 Ashihara et al. ..... 602/23
2008/0234608 A1 * 9/2008 Sankai ..... 601/5
2010/0204627 A1 * 8/2010 Kazerooni et al. ..... 602/16
2010/0280628 A1 * 11/2010 Sankai ..... 623/25

* cited by examiner

*Primary Examiner* — Danton DeMille

(57) ABSTRACT

The PARAPLEGIC CONTROLLED, CONCEALED MECHANIZED WALKING DEVICE is a thoracic/abdominal harness worn under the clothes, concealed from view, with two Motorized Gait Mechanisms with leg appendages on them, a right and a left, that with the aid of crutches with controls on the handles, that control the motorized gait mechanisms, will enable paraplegics and other types of patients with leg paralysis to stand up and walk. It will improve the quality of their lives, enable them to look and appear normal among their peers, help them maintain a high level of self-esteem and assist them in leading a more active and interesting life.

1 Claim, 8 Drawing Sheets

PARAPLEGIC CONTROLLED, CONCEALED MECHANIZED WALKING DEVICE

GENERAL DESCRIPTION OF INVENTION

Including the Manner and Process of Making and Using it

The following is a description of a Concealed Mechanized Walking Device for paraplegics. This device will enable them to stand up from a sitting position and walk upright with the aid of crutches. The crutches have controls on the handles that the paraplegic operates with his fingers to control the operation of the Concealed Mechanized Walking Device. This device is to be worn underneath their outer clothing, not visible to other people.

This mechanized walking device will be worn on the paraplegic's body, with the larger portion of it located around the lower chest area, waist and hips, concealed from view, underneath the paraplegic's outer clothes but over a protective garment of soft cloth to protect the skin. The protective garment would be worn both on the upper and the lower body (#1, FIGS. 1 & 2). With the exception of the two crutches, the person will appear, stand, and walk as a normal person.

The device consists of two main elements. The first element is a harness with right and left Motorized Gait Mechanisms which is worn on the abdominal, thoracic, waist and hip area. The second element is two crutches with controls on their handles that control the Motorized Gait Mechanisms on the harness.

The harness, worn by the paraplegic, is comprised of two Motorized Gait Mechanisms (MGMs), one on each side of the body. It also has an upper, rigid, plastic back support with a canvas or similar material portion fastened to it and the MGMs. A vertical hinge connects the MGMs to each other. This hinge is located over the person's spine from the mid to lower scapular area to the lower portion of the person's back. The vertical hinge is part of and bisects the rigid plastic back support, which is part of the harness, into a right and a left side. The vertical hinge in back allows for the harness to be opened outwards in the front enabling easier putting on and removal of the harness. The rigid plastic back support, which is an extension of the inner walls of the MGMs, or can be a separate part fastened to the MGMs, extends upwards from the MGMs to the mid scapular area of the back. The mechanical portion of each MGM is comprised of one or more electric motors in the rear portions of the unit driving a series of gears located in the side portions of the unit. Each MGM is controlled by controls on the handles of the crutches with the controls of one crutch controlling the MGM on one side of the Concealed Mechanized Walking Device and the controls on the other crutch controlling the MGM on the other side. Out of the bottom of each MGM is a metal or durable plastic appendage. The appendage extends down the lateral upper/thigh part of each leg and fastens to each leg with "C" brackets having Velcro fasteners or buckle straps. Fastened to the bottom part of the right and left thigh appendages at knee level by hinges are smaller extension appendages that extend down to above the ankle and also fasten to the legs at that point with "C" brackets and Velcro fasteners. The MGMs are powered by battery packs thus giving each MGM its own power source. The battery packs complete the harness and are located at the lower front part of the harness. Each is fastened by a hinge to each MGM and they fasten to each other with a clasp or buckle. See "Detailed Description of the First Element of the Invention: The Harness with the Motorized Gait Mechanisms (MGMs). Preferred embodiment." in the following pages.

The second element is the two crutches with controls on the handles to control the Motorized Gait Mechanisms. The controls are operated by the paraplegic's fingers and with practice the paraplegic will initiate and maintain a reciprocating stride. By using the controls on the crutches, the paraplegic will be able to activate the Motorized Gait Mechanisms causing the appendages extending out of the bottom of them to move forwards and backwards, enabling the paraplegic to stand from a sitting position and walk and also sit back down again. The crutches will also help maintain balance when walking. Some practice will be needed early on to establish rhythm and balance with the gait. Each crutch is connected to a MGM and battery pack by an electric cord running out of the top of the crutch to the MGM and battery pack that it controls. See following "Detailed Description of Second Element of Invention: The Crutches with the Controls on the Handles."

To manufacture the harness and Motorized Gait Mechanisms housings a manufacturer proficient in the designing and molding of custom high grade, rigid, durable plastic will be needed. At least three and possibly more standard sizes will need to be manufactured for different sizes of people afflicted with leg paralysis. Consideration will need to be given to the mounting and placement of different ways of fastening the working components of the MGM into the plastic housing. This will include consideration of securing the electric motors in place; to placement of bushings mounted in the inner portion of the walls of the molded MGM housings to accommodate the ends of the electric motor shafts as well as both ends of the gear axles or shafts; to placement of the static brake pad on the upper inner portion of each MGM housing; to the MGM brake lever mounts; as well as a means of providing access to these components for assembly, repair and parts replacement. This would include having one or more plate like access doors in the MGM housings, or manufacturing the MGM housings in such a way that the housings are composed of two or more parts fastened together by hinges and clasps so that when open, the inner components of the MGM are totally accessible for assembly, repair and parts replacement and when closed and clasped, the inner components are in proper place, secure and free to run properly and freely. Consideration may be given to including adjusting mechanisms such as adjustment screws, either accessible from outside or inside of the MGM housings, to maintain proper tension and spacing on the Drive Belt or Chains and the various gears and the batteries. See following "Detailed Descriptions", "Reference Numerals for Specifications" and Drawings-Figures" sections in following portion of the "Specification" section of this manuscript for further details.

A manufacturer or supplier to provide the gears needed in the MGMs is also needed. This would include the gears located in the side and flank portions of the MGMs as well as the pinion gears on the electric motors. It is presumed that the different circular gears needed for the "preferred embodiment" of the Mechanized Walking Device and the beveled circular gear for the "alternative embodiment" of the MGM as well as the pinion gears for both embodiments needed are already in existence and are available through one or more suppliers. See "Detailed Description of the First Element of the Invention: The Harness with the Motorized Gait Mechanisms (MGMs) Preferred Embodiment." and "Detailed Description of Alternative Embodiment of Motorized Gait Mechanism" in the following pages for further discussion on this topic.

The large "pie"gear and the large combination, crown and standard circular gear in the side portions of the "alternative embodiment" of the MGMs will probably need to be custom manufactured. See discussion of how these two gears work together in "Detailed Description of Alternative Embodiment of Motorized Gait Mechanism" in the following pages.

The "moments" or "torques" will need to be calculated for different sized patients to define the motor-gear ratio requirements for these different sizes people by a mechanical engineer. After this is calculated the size and strength of the electric motors needed as well as the size, type and location of the gears needed will be able to be determined. It is possible that a "one size" Concealed Mechanized Walking Device electric motor or motors combination and gear size and ratio combination will work for most sizes of people. If this is the case, adaptations for different sizes of people can be made with the plastic housings and back supports of the units.

FEDERALLY SPONSORED RESEARCH

Not Applicable

SEQUENCE LISTING OR PROGRAM

Not Applicable

BACKGROUND OF INVENTION

1. Field of invention

The inventor has worked in the health care field for many years. He has extensive experience in primary health care as well as rehabilitative health care. Having worked with paraplegics, "incomplete" quadriplegics, patients with multiple sclerosis, myelomeningocele (spina bifida) and strokes, he saw a need for a device that would enable these types of patients to stand and walk upright. This walking device would address both physiological as well as psychological needs of people with these types of ailments.

2. Prior Art

On Jun. 6, 2006 the inventor went to the U.S. Patent and Trademark Office in Alexandria, Va. to search for similar types of inventions. He did this to determine whether or not to continue pursuing the development of this invention further. No similar paraplegic controlled, motorized walking devices or patents were found.

3. Advantages

Many people with leg paralysis have good upper body strength and many do not. With the aid of crutches and the Concealed Mechanized Walking Device most of these people will be able to get up out of their wheelchairs by themselves. They will be able to stand and walk with their peers. The only visible aid to others will be the crutches. They will not be confined to a lower level of stature any longer. In most aspects they will be equal with others.

BRIEF SUMMARY OF INVENTION

The following is a description of a concealed mechanized walking device for paraplegics. Other people that may also benefit from it are some "incomplete" quadriplegics (quadriplegics with some limited use of their arms), people with multiple sclerosis, myelomeningocele (spina bifida), cerebral vascular accident (stroke), and other people with leg paralysis. These people hereafter will be referred to as "paraplegics", "persons", or "patients". This device is to enable them to stand up and walk upright with the aid of crutches.

This mechanized walking device will be worn on the paraplegic's body, with the larger portion of it located around the waist and hips, concealed from view, underneath the paraplegic's clothes. With the exception of two crutches with controls on the handgrips to control the Mechanized Walking Device (MWD), the paraplegic will appear, stand, and walk as a normal person. The device is worn by the paraplegic underneath his or her clothes but over a protective garment of soft cloth, similar to cotton long underwear, to protect the skin. The protective garment should be worn both on the upper and the lower body (#1, FIGS. 1 & 2).

The device consists of two main elements. The first element is a harness, worn by the paraplegic, which includes two Motorized Gait Mechanisms (MGMs), one on either side of the body, located at hip and waist level. Out of the bottom of each MGM is a metal or durable plastic appendage. The appendage extends down the lateral part of each leg and fastens to each leg with "C" brackets with Velcro fasteners or buckle straps.

The second element is two crutches with controls on the handgrips to control the Motorized Gait Mechanisms. By using the controls on the crutches, the paraplegic will be able to activate the Motorized Gait Mechanisms causing the appendages extending out of the bottom of them to move forwards and backwards, enabling the paraplegic to walk. The crutches will also help maintain balance when walking. Some practice will be needed early on to establish rhythm and balance with the gait.

DETAILED DESCRIPTION OF THE FIRST ELEMENT OF THE INVENTION

The Harness with the Motorized Gait Mechanisms (MGMS)

Preferred Embodiment

FIGS. 1, 2, 3, 4 and 5

The harness (#2, FIGS. 1, 2, 3 and 4) consists of two sides, a right side and a left side. Each side has two parts, an upper and a lower part. The upper and lower parts are securely fastened to each other.

The upper front and side portion of the harness consists of canvas or similar material that encompasses the upper abdominal and lower thoracic portion of the body (#3, FIGS.

1, 2 and 3) and opens in the front. It has Velcro fasteners or straps with buckles (#4, FIGS. 1 & 3) along the vertical, midline, abdominal area to fasten and secure it in place from the solar plexus area down to the belly button area of the abdomen. The canvas is fastened to the top portion of the MGMs as well as to a two-piece rigid plastic back support (#5, FIGS. 2 and 3) that has a vertical hinge (#6, FIGS. 2 and 4) in the middle of it, extending down towards the bottom of the MGMs on the backside. The purpose of the harness is to maintain stability between the upper and lower body with the help of the MGMs.

The lower part of the harness consists of two Motorized Gait Mechanisms (#7, FIGS. 1, 2, and 4 and #8, FIGS. 1, 2, 3 and 4), one on the right side and one on the left side of the paraplegic. These are located at the hip and waist level.

Figure 3:
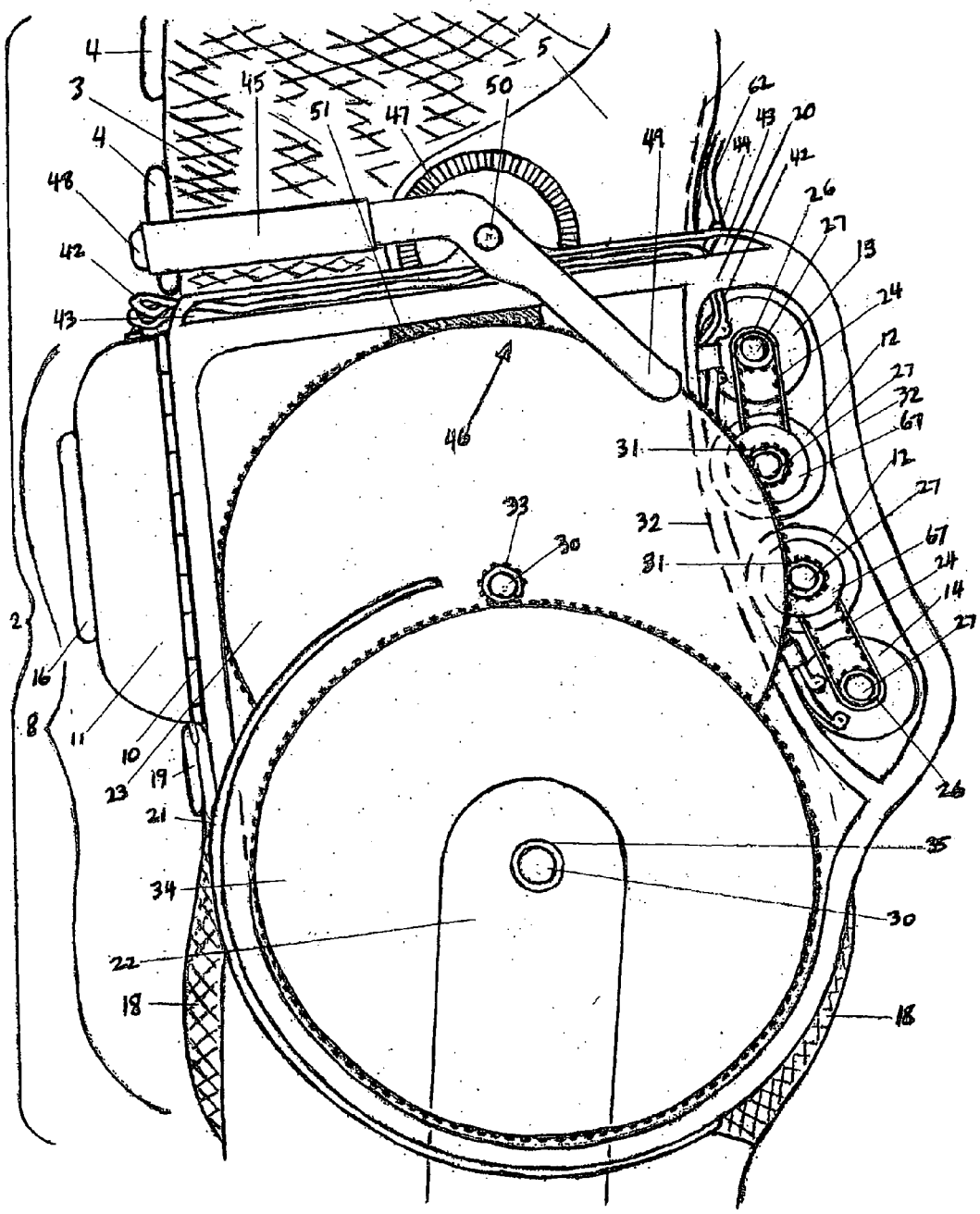
FIG. 3. Side View of the Left Motorized Gait Mechanism.

Each MGM has four electric motors arranged in a stacked, horizontal arrangement, conforming to the small of the paraplegic's back (#12, #13 and #14, FIG. 3). These motors drive a series of gears in the gearbox portion of the MGM along the right and left sides of the paraplegic.

Fastened to the last gear in the gearing sequence is the leg appendage (#22, FIGS. 1, 2, 3 and 4) extending out of the bottom of the MGM down along the lateral part of the paraplegic's leg.

Figure 2:
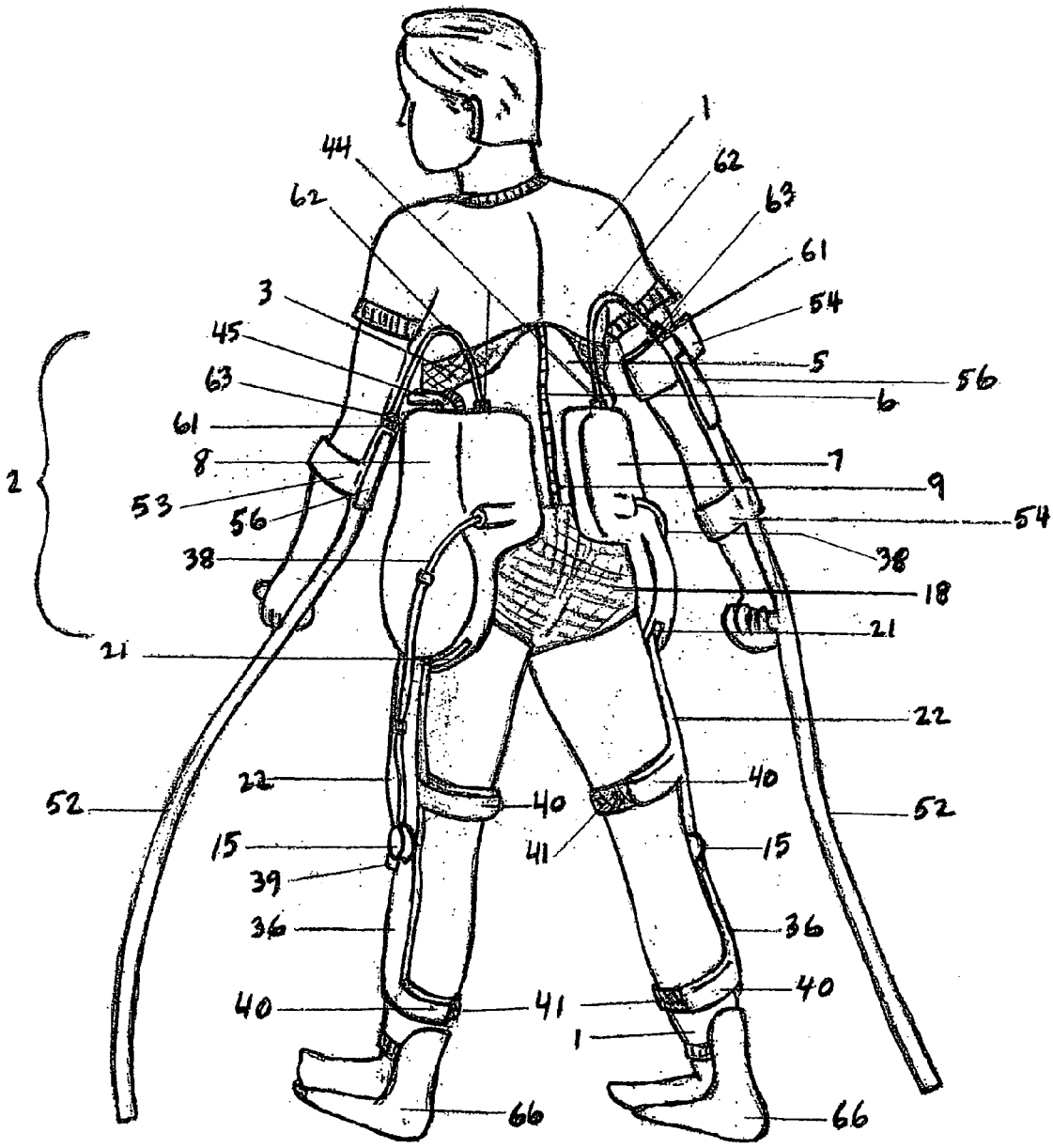
FIG. 2. Rear View of the Concealed Mechanized Walking Device.

As stated before, securely and rigidly fastened to the MGMs and extending up the back, from the MGMs, to the area between the patient's scapulas, is the two-piece durable, rigid, plastic, back support (#5, FIGS. 2 & 3). It is fastened to the canvas portion of the harness. As stated before, it is hinged (#6, FIGS. 2 & 4) vertically in back, in the middle, along the spine, dividing the harness into an equal right and left side. The right and left MGMs are also connected by the same hinge, which is on the lower portion of the rigid, plastic, back support, extending down along the spine, between the MGMs (#9, FIG. 2). This vertical hinge in the back allows the harness to open outwards to the sides in the front, making the harness easy to put on and take off.

Figure 1:
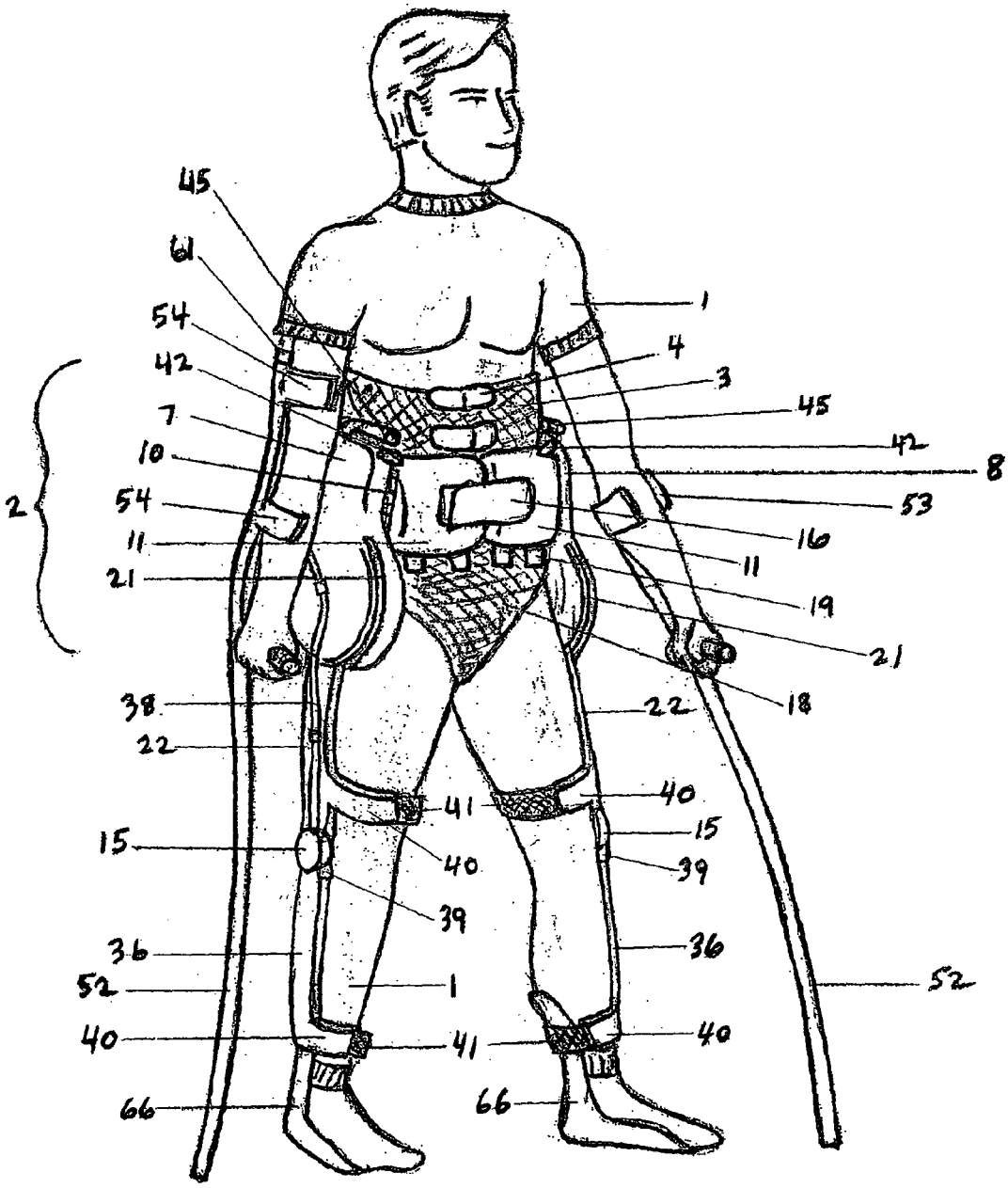
FIG. 1. Front View of the Concealed Mechanized Walking Device.
Figure 4:
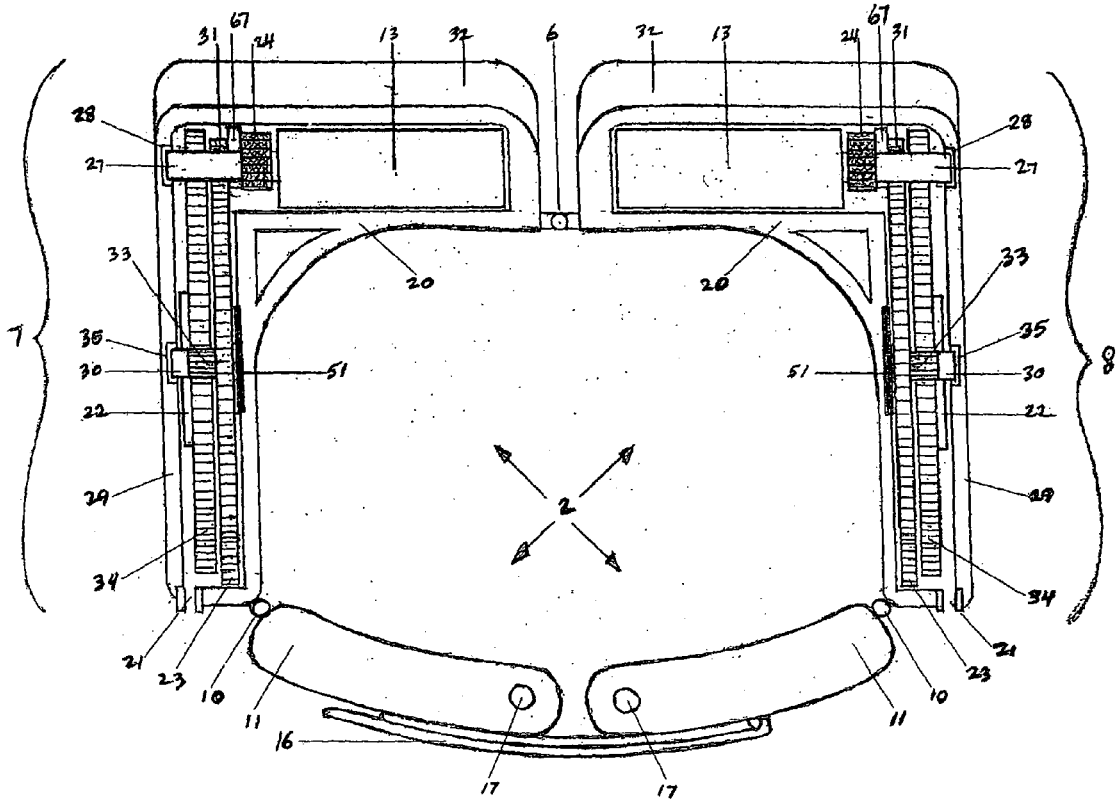
FIG. 4. Top View and Cross Section of the Lower Part of the Harness including both Motorized Gait Mechanisms and Battery Packs.
Figure 5:
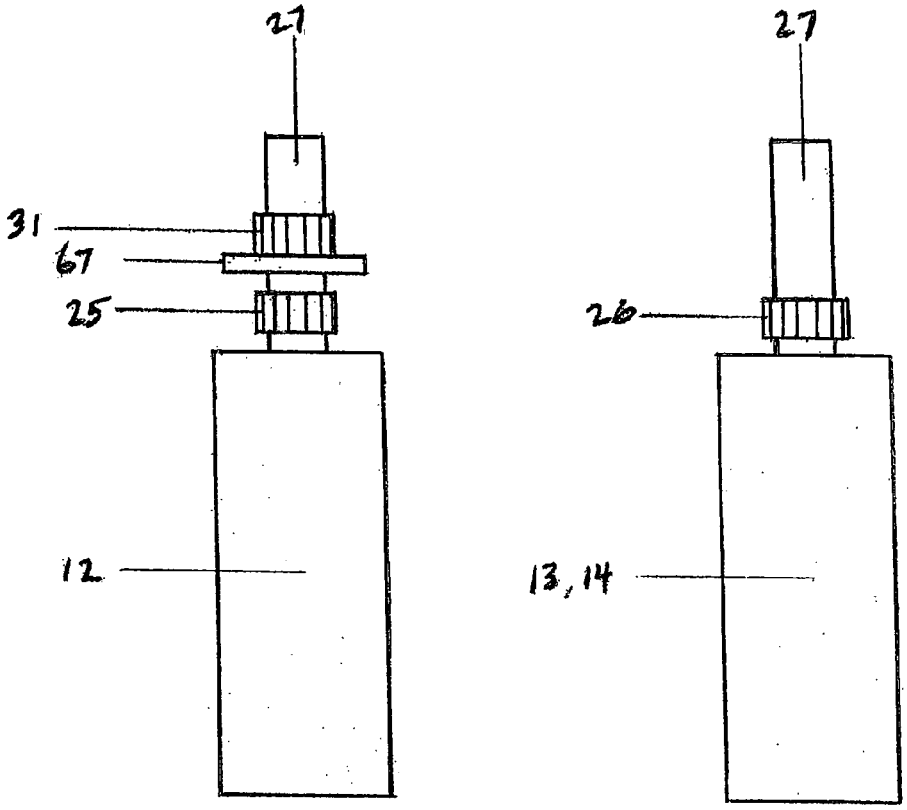
FIG. 5. View of the Electric Motors and the Two Different Pinion Gear Arrangements on them.

Fastened by a hinge (#10, FIGS. 1, 3 & 4) to the front, vertical edge of each MGM, and extending half way across the abdomen, is a rechargeable battery pack (#11, FIGS. 1, 3 & 4). The battery packs along with the MGMs encircle the paraplegic's torso, creating the lower two-thirds or three-fourths of the harness. The battery packs are the power source for the electric motors in the rear portion of each MGM (#12, #13 and #14, FIG. 3 and #13, FIG. 4). They are also the power source for the knee brakes located within the two knee hinges (#15, FIGS. 1 and 2). The battery packs fasten to each other in front with a wide Velcro or buckle clasp (#16, FIGS. 1, 3 and 4). This along with the Velcro or buckle clasps on the front, upper, canvas portion of the harness (#4, FIGS. 1 and 3) helps secure the harness and MGMs in place. The battery packs have receptacles (#17, FIG. 4) on them for recharging.

[RAMIFICATION: Two clasps, rather than one, an upper and a lower, might be needed to fasten the battery packs to each other to reduce reactionary movement of the harness from the action of the MGMs and the leg appendages].

The harness has a seat flap portion (#18, FIGS. 1, 2 and 3), which is fastened to the bottom, rear portion of the MGMs. It extends from the lower portion of the back of the harness under and through the groin area up to the front, lower abdominal area where it fastens to the lower part of the battery packs, over the lower abdomen, with Velcro straps or buckle straps (#19, FIGS. 1 and 3). This creates a support, which prevents the person from possibly slipping down and through the harness. When undone the person can go to the bathroom while wearing the harness. This will probably take some practice. The seat flap portion could possibly be removed once the paraplegic was comfortable and proficient with the use of the walker.

The harness can be put on by the paraplegic while he is sitting up in bed. Many paraplegics can prop themselves up with their arms and are limber enough to bend forward far enough when sitting up in bed to put on their own shoes and socks with their legs lying straight on the bed. So they should have no trouble putting the harness on and fastening the appendages to their legs. If they are obese or are unable to bend forward that far, they may need assistance. The two Motorized Gait Mechanisms are enclosed in durable, plastic housings (#20, FIGS. 3 and 4). The plastic housings are contoured to the paraplegic's body and may be insulated to minimize motor and gear sound. There will need to be one or more removable panels for assembly, service or repair on each MGM. As stated before, one MGM is on the right side (#7, FIGS. 1, 2, and 4) of the paraplegic and wraps around to his or her back and the other MGM is on the left side (#8, FIGS. 1, 2, 3 and 4) and wraps around to the back. They are connected together by the vertical hinge in the back.

There is a track or guide (#21, FIGS. 1, 2, 3 and 4) on the bottom of each MGM that the appendages (#22, FIGS. 1, 2, 3 and 4) extend out of, and travel through when walking. When the paraplegic is sitting in bed, the guides extend far enough up the front of the MGM housings to allow for the legs to come forward and up, which allows the torso of the paraplegic to lean forward to within 20 to 30 degrees of the axis of his or her legs when sitting in bed. This again allows the person to bend forward at the waist far enough to fasten the appendages to his or her legs. The same guide extends to the rear, lower portion of each MGM allowing the appendage at the end of a stride to extend back to 30 degrees behind the vertical axis of the body or torso. Within the limits of the guides on the right and left MGMs, the paraplegic will be able to walk by taking reciprocating strides, controlled by the controls on the crutches.

Within both the right and the left motorized gait mechanisms there are four electric motors. The inventor envisions four electric motors needed to power each the right and the left Motorized Gait Mechanisms, for a total of eight motors in the entire unit. The two middle motors (#12, FIGS. 3 and 5) will have pinion gears (#31, FIGS. 3, 4 and 5) engaging the large, top/upper circular gear (#23, FIGS. 3 and 4) in the MGM. The two middle motors will be linked to the top and the bottom motors (#13 and #14, FIGS. 3 and 5), (#13, FIG. 4) with drive belts or drive chains (#24, FIGS. 3 and 4), with all turning in unison, driving the two pinion gears on the two middle electric motors (#31, FIGS. 3 and 5), which as stated previously, turn and drive the large, top/upper, circular gear (#23, FIGS. 3 and 4) in the MGM housing. The drive belts or chains ride on pinion gears (#25, FIG. 5) (#26, FIGS. 3 and 5) located on the electric motor shafts (#27, FIGS. 3, 4 and 5) closer to the motors. There may need to be an adjustment screw or device to adjust the tension of the drive belts or chains.

[RAMIFICATION: Four motors may or may not be needed to power the MGMs. The following examples marked by an (*) are other combinations of motors that could possibly be used to drive the MGM depending upon the actual strength and speed of the motors. At the current time the inventor is financially unable to build a prototype of the walker to actually determine exactly what type of motors to use, as well as how many.

Also still needing to be determined are the exact gear ratios for the gears in the MGM gearboxes. The approximate placement and general size proportions of the gears to one another are depicted in FIG. 3. Following are some possible other electrical motor scenarios.

If only one electric motor is needed to power each Motorized Gait Mechanism, that motor would have one pinion gear on it that would engage the large, top/upper, circular gear (#23, FIGS. 3 and 4) in the MGM.

If two electric motors are needed to power each MGM, each motor would have one pinion gear on it that would engage the large, top/upper, large, circular gear (#23, FIGS. 3 and 4) in the MGM.

If three electric motors are needed to power each MGM, one of the two electric motors engaging the large, top/upper, large, circular gear (#23, FIGS. 3 and 4) in the MGM would also be linked by a metal drive belt or drive chain to a third electric motor.]

The shafts extending out of all of the electric motors (#27, FIGS. 3, 4 and 5) and the large circular gears (#30, FIGS. 3 and 4) in the MGMs shall be long enough to fit into bushings or bearings (#28, FIG. 4) and (#35, FIGS. 3 and 4) encased in, or mounted on, the inner portions of the outside lateral walls (#29, FIG. 4) of the MGMs. On the two middle motors (#12, FIGS. 3 and 5) of each MGM, both pinion gears on the motor shaft shall be separated by a bushing (#67, FIGS. 3, 4 and 5). The purpose of these bushings is to keep the drive belt or chain connecting the electric motors from touching or rubbing against the large upper circular gear (#23, FIGS. 3 and 4).

The pinion gears (#25, FIG. 5) on the shafts of the middle electric motors (#12, FIGS. 3 and 5) closest to the motors, connect to either the upper or lower, electric motors (#13 and #14, FIGS. 3 and 5) by a drive chain or belt (#24, FIGS. 3 and 4).

On the two middle motors, on the other side of the bushing (#67, FIGS. 3, 4 and 5) away from the motor, are the pinion gears (#31, FIGS. 3, 4 and 5) that will engage and drive the large, upper, circular gear (#23, FIGS. 3 and 4).

The top and bottom electric motors (#13, FIGS. 3, 4 and 5 and #14, FIGS. 3 and 5) only have the pinion gear (#26, FIGS. 3 and 5) on the inner ⅓ of the electric motor shaft closest to the motor, which is connected to the two middle electric motors by the drive chain or belt (#24, FIGS. 3 and 4). As stated before the electrical motor shafts extend across to the outside lateral wall of the MGM housings, where they insert into the bushings or bearings located there (#28, FIG. 4).

The rear portions of the MGMs, housing the electric motors, are arranged in a slight concave curvature formation (#32, FIGS. 3 and 4) to conform to the small of the back of the paraplegic. In the side gearbox portion of both the right and the left Motorized Gait Mechanisms (MGMs) there is a series of two large circular gears. There is a small pinion gear (#33, FIGS. 3 and 4) mounted in the hub of the large top/upper circular gear (#23, FIGS. 3 and 4). This small pinion gear engages the outer circumference of the large, lower, circular gear (#34, FIGS. 3 and 4). The outer circumference of the large, top/upper gear (#23, FIGS. 3 and 4), as stated before, is engaged with the two pinion gears (#31, FIGS. 3 and 4) on the two inner or middle, electric motors (#12, FIGS. 3 and 5). This gearing is designed to reduce the faster speed of the electric motors to slower, usable torque speed by the time it reaches the leg appendage.

The last gear in the gear sequence, which is the lower, large, circular gear (#34, FIGS. 3 and 4), is positioned so that the hub or center of it, is at the same level, and just lateral to, the patient's hip joint. This allows it to pivot as the client's hip would pivot in a forward and backward, inline, reciprocating, or otherwise desired gait. The gait would be controlled by the paraplegic with the controls on the handles of the crutches.

The axles or shafts (#30, FIGS. 3 and 4) of both the upper and lower, large, circular gears seat in bushings or bearings (#35, FIGS. 3 and 4) encased in, or fastened onto, the inner side of the outer walls of the MGM housings (#29, FIG. 4).

[RAMIFICATION: Depending upon the strength of the electric motors, the number of electric motors needed, and the correct gearing needed, to achieve the desired result, the inventor foresees the need for possibly having up to five, large, circular gears in the gearing sequence. There may be a need to include two to four large circular gears with pinion gears, into the configuration of the gears, in the MGM gearbox, above the last, bottom gear in the gearing sequence, that the leg appendage is fastened to. This would be to reduce the higher spinning speed of the electric motors to usable torque at the leg appendage. They could be arranged either in an inline or staggered configuration, or a combination of both. The last, or bottom, large, circular gear would still have the leg appendage fastened to it. Fastened to the outer portion of the lower, large, circular gear in each MGM is the leg appendage (#22, FIGS. 1, 2, 3 and 4). The leg appendage extends out of the bottom of the MGM housing and travels through a track or guide (#21, FIGS. 1, 2, 3 & 4) located on the bottom and front portion of the MGM housing. The tracks or guides would have rubber stops located at the ends of them so as to cushion the stopping of the leg appendage should it be extended too far forwards or backwards. The leg appendage is made of lightweight metal or durable, rigid plastic. It is contoured to the lateral aspect of the paraplegic's thigh down to the level of the knee joint.

At the end of the thigh appendage, directly lateral to the knee joint, is a hinge (#15, FIGS. 1 & 2). A second, contoured, metal or plastic appendage (#36, FIGS. 1 and 2) extends down from the knee hinge along the lateral part of the paraplegic's lower leg, to below mid-calf and ends above the patient's ankle.

The knee hinge has a brake on it, or within it, that keeps the knee locked in whatever position it is currently in. The brake can be released by depressing a lever on the handles of the crutches (#37 FIG. 6) that releases the hinge and allows the lower leg to swing. The brake will probably be operated by an electric motor or device in or on the hinge that is powered by the battery pack. An electric cord (#38, FIGS. 1 and 2) connects the knee brake to the lever on the crutch handle and to the battery pack for each leg. Refer to the crutch and controls section for further information on the levers and controls.

There are a total of four electrical circuits on the walker, two on the right side unit and two on the left side unit. On each unit, the first circuit includes the battery pack, electric motors and the electric motor controls on the crutch handles. The second circuit on each unit includes the battery pack, the knee brake and the brake controls on the crutch handles.

The knee hinge should probably be built with a small amount of friction or drag within it to prevent the lower leg from swinging totally free when walking. This could possibly cause injury to the knee joint when swinging forward too hard or too fast. There should be a setscrew with a Teflon or plastic tip on it, in the hinge to adjust the amount of drag in the hinge. Due to wear from friction or changes in climatic conditions, the setscrew may need to be periodically adjusted. It will be to the paraplegic's discretion as to how much or how little drag they want in the knee hinge.

The knee hinge also should have a "stop" (#39, FIGS. 1 and 2) on it to prevent the lower leg from swinging forward too far and possibly hyper extending the knee which could cause injury.

Fastened to the upper metal appendage above the knee and also to the lower metal appendage above the ankles are formed durable metal or plastic "C" brackets (#40, FIGS. 1 and 2). The paraplegic's leg at these points will fit into the "C" brackets. The "C" brackets have Velcro or buckle straps (#41, FIGS. 1 and 2) that secure the person's leg securely into them at these points. The "C" brackets and straps are padded to allow for comfort and protection of the skin.

The wires or cord (#42, FIGS. 1 and 3) connecting the battery packs to the electric motors, travel through a separate channel on the top part of the MGM housings (#43, FIG. 3). The electric cord coming from the controls on the crutches enters the top of the MGM housings (#44, FIGS. 2 and 3). The cords for the knee brakes continue down through the rear part of the MGM housings near the electric motors and exit out of the MGM housings, and continue down the leg appendages to the knee brakes (38, FIGS. 1 and 2).

On the top of each MGM on the outside is a lever or handle (#45, FIGS. 1, 2 and 3) that can be pulled up, to lock a brake (#46, FIG. 3) within each MGM. The purpose of these brakes is to act as a parking brake when the paraplegic is standing but not walking. The brakes can be "set" so that the paraplegic can let go of the crutch handles to use his or her arms and hands. When the brakes are set, the gears in the MGM cannot move, preventing them from turning. This keeps the leg appendages from moving, thus preventing possible collapse. The lever or handle would be similar to that of a floor mounted parking brake in a sports car. As the lever would be pulled up, tension would increase on the brake. A ratchet system (#47, FIG. 3) would hold the lever and brake in place. A release mechanism mounted on the handle would release the ratchet and brake. This could be either a button (#48, FIG. 3) extending out of the end of the handle, or a release lever mounted on the side of the handle.

The actual braking device is such that when the brake lever is pulled up, the extension of the lever (#49, FIG. 3), on the other, lower side of a fulcrum hinge (#50, FIG. 3), presses against the upper, outer side, of the top, upper, large circular gear (#23, FIGS. 3 and 4), inside the MGM. The lever would pivot at the fulcrum point, or hinge, on the topside of the MGM (#50, FIG. 3). Below the pivot point, inside the MGM housing, the lower portion of the lever (#49, FIG. 3) extends down along the side of the upper, large, circular gear (#23, FIGS. 3 and 4). From the far, lower end of the lower portion of the lever, back up towards the pivot point, it increases in thickness on the inside, or the side towards the gear. As the brake handle is raised, the lower part of the lever beyond the pivot point advances down along the side of the gear pressing the gear in a cam like fashion against a static brake pad (#51, FIGS. 3 and 4) installed on the upper, inner portion of the MGM housing. This brake pad would be positioned close enough to the circular gear that it may lightly touch the gear, but not enough to cause restrictive friction on the gear, when it is turning. The concept is similar to disc brakes on a car, but in this case, only the outer pad, which is the inner surface of the lower part of the MGM brake lever, moves and pinches the gear into the inner pad mounted in the housing, when the brake is set. The brake handles could possibly be lengthened to curve around and extend across the front portions of the abdomen. This would make them easier to grasp onto, and to pull up, and to release. (Remember that the gear is not turning but is stopped when the brakes are set. It is presumed that not too much pressure would be needed to keep the gear from moving, thereby keeping the MGMs locked in place.)

[RAMIFICATION: A possible alternative MGM braking mechanism could be to have the brakes set by depressing a button protruding out of the end of the crutch handle, or a third lever or button mounted on the crutch handle or crutch shaft. This would activate a brake inside the MGM. In this case the brake would presumably be activated by an electric motor.

DETAILED DISCRIPTION of the SECOND ELEMENT of the INVENTION

The CRUTCHES with the CONTROLS ON THE HANDLES

PREFERRED EMBODIMENT

Figure 6:
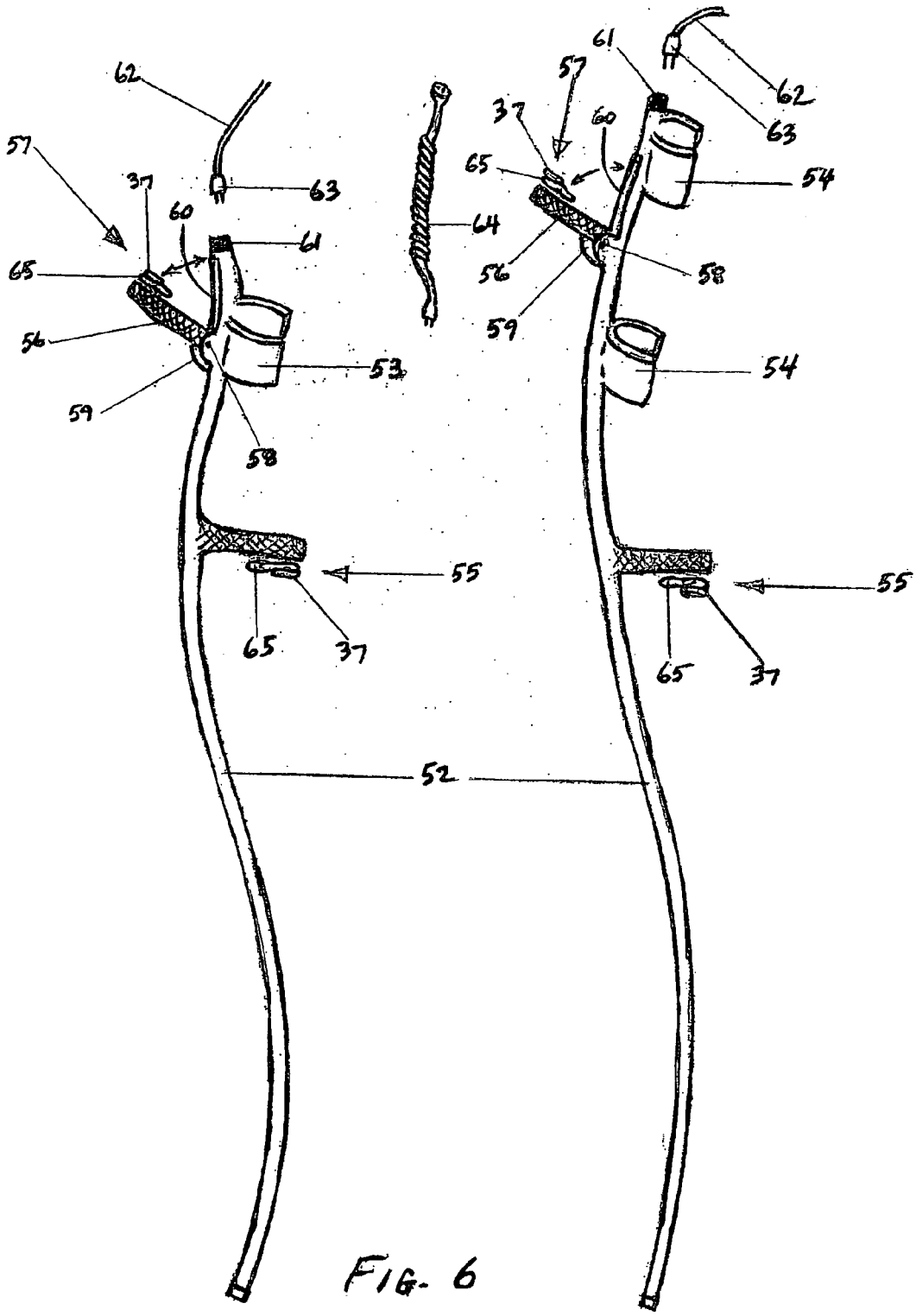
FIG. 6. View of the Two Types of Crutches with the Controls on the Crutch Handles including the Main Handles and the Auxiliary "Flip Down" Handles.

FIGS. 1, 2 and 6

The second element of the mechanized walking device is the crutches (#52, FIGS. 1, 2 and 6). The crutches are single legged and made of lightweight metal. They can be either with a low arm bracket (#53, FIGS. 1, 2 and 6) for the forearm to fit into, or with a high and low arm bracket (#54, FIGS. 1, 2 and 6) for the forearm and upper arm to fit into. This would depend upon the paraplegic's preference and/or needs.

An Alternative Embodiment is that conventional crutches may also be used but the inventor believes that single legged crutches would be more suitable.

On the handles of the crutches are the controls (#55, FIG. 6) for operating the Motorized Gait Mechanisms and knee brakes. The controls on one crutch operate the Motorized Gait Mechanism and knee brake on the right side of the harness and the controls on the other crutch operate the Motorized Gait Mechanism and knee brake on the left side of the harness. It would be the paraplegic's preference as to which side he or she would like which crutch and controls, to operate which MGM, leg and knee brake.

Mounted on the back of each crutch, higher up the shaft, above the elbow, are auxiliary sets of "flip down" handles (#56, FIGS. 2 and 6). These "flip down" handles have auxiliary controls (#57, FIG. 6), in the same configuration as the controls on the main handles, to operate the MGMs. The flip down handles, when pulled out and down, enable the paraplegic to grasp onto, when in a sitting position, and activate the MGMs with the controls on them, to assist him or her to a standing position from a sitting position, while also pulling him or herself up with his or her arms. A hinge (#58, FIG. 6) fastens the auxiliary handles to the crutch. There is a "stop" (#59, FIG. 6) mounted on the shaft of the crutch, below the hinge that allows the handles to drop down only far enough for the paraplegic to comfortably grasp onto and keep the handles from dropping down any further. The "flip down" handles, when not in use, recess back into the upper, back part of the shaft of the crutch (#60, FIG. 6).

The controls on the crutches are connected to the MGMs by a cord or wires going from the controls on the crutch handles, through the upper, hollow shaft of the crutch, up to the top of the crutch, where there is an electrical receptacle mounted on the top of the crutch shaft (#61, FIGS. 1, 2 and 6). The other part of the wire (#62, FIGS. 2, 3 and 6) extends from the top of the MGM up along the side or back of the harness, across the rear part of the paraplegic's shoulder, and then down along the back of the upper arm, through the shirt sleeve, and ending with a male plug (#63, FIGS. 2 and 6). This cord would end at about the level where the receptacle is on the top of the shaft of the crutch. The plug inserts into the receptacle to complete the electrical connections from the controls on the crutch handles to the batteries and electric motors in the Motorized Gait Mechanisms as well as to the batteries and the knee brakes.

To conceal this wire the paraplegic should wear short sleeve shirts that have long enough sleeves to cover the wire.

With the wire being able to be disconnected from the top of the crutch, the paraplegic can unplug the wire when in a sitting or standing position, thus enabling him or her to use their arms, unencumbered by the crutches, and setting the crutches aside.

In the event that there is a need for a longer wire, coiled extension cords (#64, FIG. 6) of the same gage, with compatible plugs on one end and compatible receptacles on the other end, may be inserted in-between the receptacles on the tops of the crutches and the wires coming from each MGM. These may be used when going from a sitting position to a standing position or vice versa, or when getting into or out of a vehicle. Should the paraplegic want to set the crutches aside for a period of time, a clip on the male/crutch end of the coiled extension wire could clip onto the inside of the shirt sleeve, keeping the wire out of view, inside the shirt, yet still accessible. In the event that a suit coat, overcoat, long sleeve shirt or sweater is worn, a small opening stitched into the armpit of the apparel would allow the cord to pass through from the MGMs to the crutches.

The controls on each crutch can be custom manufactured per the paraplegic's need or preference. The inventor envisions that each crutch handle has a double action, fulcrum type of lever (#65, FIG. 6) mounted towards the front of the handle on the finger side. On the main handles the controls would be on the bottom, and on the flip down handles the controls would be on the top. These controls would be operated by the index finger and the middle finger in an alternating fashion.

By depressing the front portion of the fulcrum lever with the index finger, the MGM that would be controlled by the controls on that crutch, would be activated, the electric motors would turn, causing the appendage on that side, extending down the leg from the motorized gait mechanism, to move forward, extending the leg forward in a stride. The other MGM on the other side would be run by the controls on the other crutch.

Depressing the rear part of the fulcrum lever, with the middle finger reverses the polarity of the electric motors in the MGM. This causes the electric motors to reverse direction, causing the MGM gearing to turn backwards. This causes the appendage mounted on the lower, large circular gear (#34, FIGS. 3 and 4) in the MGM, to move towards the back, thus propelling the paraplegic forward. The top of the leg appendage is located at the center of the lower, large, circular gear in the MGM. This is also the pivot point for the leg appendage and is located even with the paraplegic's hip joint (#30, FIG. 3).

By alternately depressing the front of the fulcrum lever with the index finger on one hand, on one crutch, while depressing the rear part of the fulcrum lever with the middle finger, of the other hand, on the other crutch, and then vice versa, and continuing on with this alternating sequence, a reciprocating gait is created. It is assumed that there will be some practice needed to get the hang of it. The fulcrum lever should be a variable speed type of switch so as to be able to operate the electric motors and MGMs at variable speeds.

A second lever (#37, FIG. 6), located even with the front part of the above-mentioned double action, fulcrum lever on each crutch handle is to be depressed simultaneously by the index finger along with the front part of the fulcrum lever. This is to release the knee brake on or within the knee hinge (#15, FIGS. 1 & 2), after the paraplegic's weight is transferred to the other leg. This allows the knee on the forward swinging leg to bend as it swings through during a forward stride. This will allow the person's foot to clear the ground without having to lean the opposite way too much, away from the swinging leg, to achieve clearance from the ground, while also maintaining a more normal and natural looking gait.

Upon completing a forward stride, by releasing the front part of the fulcrum lever (#65, FIG. 6) and releasing the brake lever (#37, FIG. 6) at the same time, the knee brake will relock, holding the knee joint in place. This then allows the knee joint to remain rigid while propelling the person forward during a front to back stride, by depressing the rear part of the fulcrum lever. By depressing the front part of the fulcrum lever and the knee brake release lever, right next to it simultaneously, the knee joint is relaxed and can bend at the same time as when the leg is advanced forward.

The inventor envisions the knee brake as always being on when the second lever is not depressed. This is meant to be a safeguard against the leg or legs collapsing. By depressing the second lever, a small electric motor is activated, that releases the tension or the pressure of the brake. The knee brake release lever should be spaced a little ways away from the front part of the fulcrum lever on the crutch handle so that if the paraplegic chooses to push the front part of the fulcrum lever separately but keep the knee brake locked, he or she can do so without difficulty. For simplicity of operation, the fulcrum lever should probably be placed on the outside, lower portion of the crutch handle and the brake lever placed on the inside, lower portion of the crutch handle.

[Ramification: The knee brake could be also be a tension brake that could be released by a cable coming from the second lever on the crutch handle. By depressing the lever the tension on the brake would be released and by letting go of the brake lever the tension on the brake would resume. The cables would be similar to bicycle brake cables.]

As stated before there will need to be a wire or cord (#38, FIGS. 1 and 2) that runs down along the leg appendage from each MGM housing to the brake on the knee hinge. This cord contains the wires that complete the circuit from the controls on the crutches to the battery pack and knee brake. It might need to be encased in a protective conduit.

As stated before, as a safety feature, the knee hinge will be locked in whatever position it is in when the knee brake lever is not depressed. Also, as stated before, if needed, a certain amount of drag or friction may need to be built into the knee hinge, to prevent too much or too fast of a free swing forward and through by the lower leg, to prevent injury to the paraplegic's knee joint. And also, as stated before, there is a "stop" built into the hinge to prevent the knee hinge from swinging too far forward and thus running the risk of hyper extending the knee joint.

In regards to the person going from a sitting position to a standing position, or vice versa, there will need to be practice involved to master the multiple tasks of grasping the regular handles or flip down handles while also alternately controlling the brake release levers and fulcrum levers on both crutches. The MGM brakes might also be used in these situations.

REFERENCE NUMERALS for SPECIFICATION and DRAWINGS of PREFERRED EMBODIMENT

MOTORIZED GAIT MECHANISM, HARNESS and CRUTCHES with CONTROLS on the HANDLES

FIGS. 1, 2, 3, 4, 5 and 6

1. Protective garment
2. Harness
3. Upper, canvas portion of harness

4. Velcro fasteners or straps with buckles
5. Two piece, rigid, plastic back support
6. Vertical hinge of two piece, rigid, plastic back support
7. Right Motorized Gait Mechanism (MGM)
8. Left Motorized Gait Mechanism (MGM)
9. Lower portion of rigid, plastic back support located between both MGMs
10. Hinge connecting MGM and battery pack
11. Rechargeable battery pack
12. (Middle) Electric motors in the vertical motor arrangement in each MGM
13. (Top) Electric motor in the vertical motor arrangement in each MGM
14. (Bottom) Electric motor in the vertical motor arrangement in each MGM
15. Knee hinge
16. Wide Velcro or buckle clasp
17. Battery pack recharging receptacle
18. Harness seat flap
19. Seat flap Velcro straps or buckle straps
20. Motorized Gait Mechanism housing
21. Leg appendage track or guide on the bottom of each MGM
22. Leg appendage
23. Large, top/upper circular gear in each MGM
24. Drive belts or chain
25. Pinion gear
26. Pinion gear
27. Electric motor shaft
28. Bushings or bearings holding electric motor shaft ends
29. Outside, lateral wall of MGM
30. Large circular gear shafts
31. Outer pinion gears on the two middle motors
32. Concave, curvature formation of rear portion of MGM housing to conform to small of paraplegic's back
33. Pinion gear located at hub of large top/upper circular gear
34. Large, lower, circular gear
35. Bushings or bearings holding large circular gears axles or shafts
36. Second, lower leg appendage, hinged to upper leg appendage, extending down below knee
37. Knee brake release lever on crutch
38. Knee brake electric cord
39. Knee hinge "stop"
40. "C" brackets
41. "C" bracket Velcro or buckle straps
42. Electric wires connecting battery packs to electric motors
43. Built in channel or conduit on top of MGM housings for electric wires
44. Entry point on top of MGM housing for electric cord from crutches
45. MGM brake lever
46. MGM brake
47. MGM brake and brake lever ratchet device
48. MGM brake release button
49. Lower end of brake lever located on other side of fulcrum point
50. Fulcrum point of MGM brake
51. In place static brake pad mounted in MGM housing
52. Crutches
53. Crutch with low arm bracket
54. Crutch with low and high arm bracket
55. Controls on crutch handles
56. "Flip down" handles on upper, rear portion of crutches
57. Controls on "flip down" handles
58. "Flip down" handle hinges
59. "Flip down" handle "stops"
60. "Flip down" handle recesses in upper, back part of crutches
61. Electrical receptacle located on top of crutch shaft
62. Electrical wire extending from MGM to crutches
63. Male electrical plug on end of wire extending from MGM
64. Additional coiled extension wires for more length and latitude of movement
65. Double action fulcrum lever
66. APA foot supports or similar type of foot brace
67. "Separation" bushing on middle electric motor shafts

DETAILED DESCRIPTION of the ALTERNATIVE EMBODIMENT of the MOTORIZED GAIT MECHANISM

Figure 7:
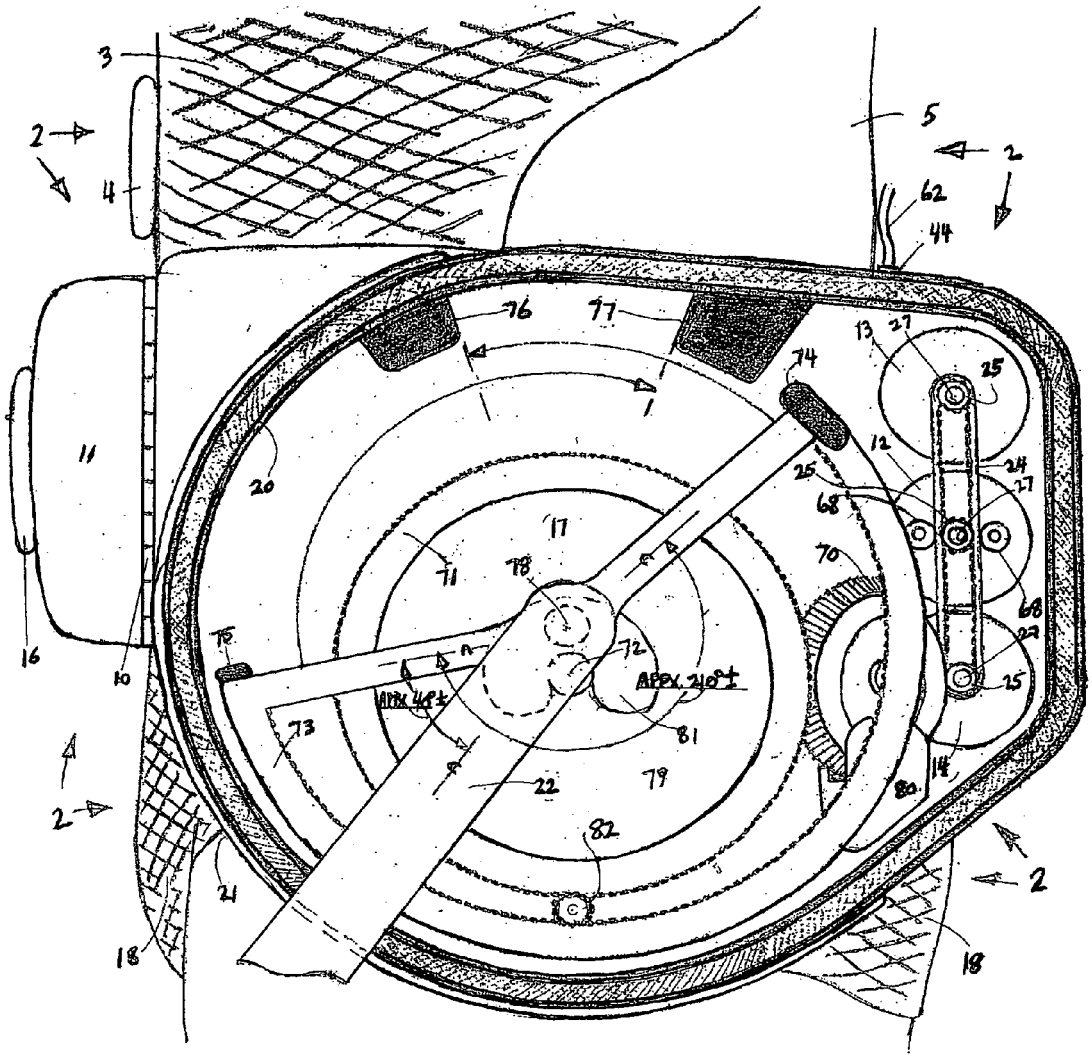
FIG. 7. Side View of the Alternative Embodiment of the Left Motorized Gait Mechanism.
Figure 8:
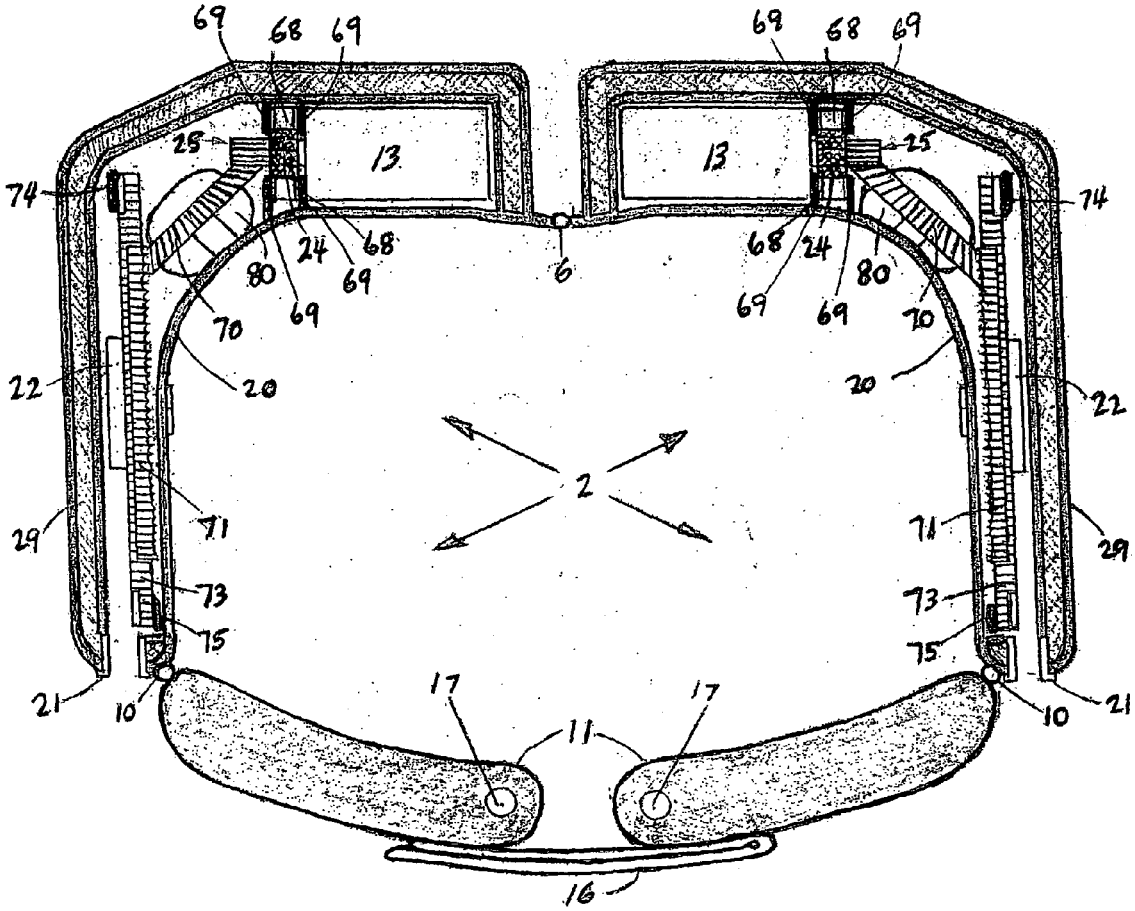
FIG. 8. Top View and Cross Section of the Alternative Embodiment of the Harness including both Motorized Gait Mechanisms and the Battery Packs.

FIGS. 7 and 8

The purpose of this Alternative Embodiment concept of the MGM is to make it more streamline, compact, and less noticeable when worn underneath the person's clothes. The basic concept and design of the Paraplegic Controlled, Concealed Mechanized Walking Device remains the same.

The major difference involves placing a circular bevel gear (#70, FIGS. 7 & 8) at forty-five degrees, in the flank area of each MGM, between the electric motor or motors (#12, #13, #14, FIG. 7 and #13, FIG. 8) in the rear portions of the MGMs, and the gears (#71, #73, FIGS. 7 & 8) on the sides of the MGMs. The placement of a beveled circular gear in the flank area of the MGM between the back and the sides of the paraplegic would allow the MGM housing to contour more closely with the paraplegic's body in the right and left flank areas, making the MGM less noticeable under the patient's clothes. This could be made to adapt to the previously mentioned gearing sequences shown in FIGS. 3 and 4, and discussed in the previous "preferred embodiment" design, or it could mesh with the different type of gearing sequence depicted in FIGS. 7 and 8. The end result would still be the same, that being the forward and backward movement of the leg appendages (#22, FIGS. 7 & 8) extending out of the bottom of the MGMs.

The MGM gearing sequence depicted in FIGS. 7 and 8 include a large circular gear (#71, FIGS. 7 & 8) that is a combination of both a standard circular and crown gear in the side sections of the MGMs as well as a large "pie" shaped gear (#73, FIGS. 7 & 8) with the gear teeth on the inner portion of the outer circumference of the gear. The "pie" shaped gear would be approximately 210 degrees. The outer circumference of the combination circular/crown gear engages a pinion gear (#82, FIG. 7) mounted in the MGM housing that transfers motion to the large "pie" gear (#73, FIGS. 7 & 8). The teeth of the crown portion of the combination circular gear are on the inner side portion of the gear, towards the wearer of the MGM harness. The crown portion of the circular gear (#71, FIGS. 7 & 8) meshes with the beveled gear (#70, FIGS. 7 & 8) positioned at forty-five degrees in the flank area in each MGM. The beveled circular gear also meshes with a pinion gear (#25, FIGS. 7 & 8) on one of the electric motors.

The leg appendage (#22, FIGS. 7 & 8) is fastened to the "pie" gear and is positioned approximately 40 degrees behind the backwards rotating leading edge of the pie gear and approximately 170 degrees ahead of the forward rotating leading edge of the pie gear. On both leading, rotating, edges of the pie gear are rubber bumpers (#74, #75, FIGS. 7 & 8) that allow the pie gear to rotate only so far in either direction before stopping by hitting "stop pads" (#76, #77, FIG. 7) mounted on the top, inside portion of the MGM housing. It is presumed that the person will master the use of the Mechanical Walking Device to the point of the stop pads not being used very often.

The MGM brake (#80, FIGS. 7 & 8) in this alternative version would probably be a electrical or mechanical brake that would pinch or clamp the circular beveled gear (#70, FIGS. 7 & 8)

The right and left MGMs would still be connected to each other by a vertical hinge (#6, FIG. 8) in back. The front portion of the harness would still consist of the two battery packs (#11, FIGS. 7 & 8) that fasten to each other with a clasp or buckle (#16, FIGS. 7 & 8) and are fastened to each MGM by a vertical hinge (#10, FIGS. 7 & 8). See Alternative Embodiment of MGM Concept in FIGS. 7 and 8. Number 81 in FIG. 7 is an open space in the circular combination gear to allow it to rotate around the pivot point (#78, FIG. 7) of the pie gear.

REFERENCE NUMERALS for the SPECIFICATIONS and DRAWINGS

For the ALTERNATIVE EMBODIMENT of the MOTORIZED GAIT MECHANISM

FIGS. 7 and 8

2. Harness (lower portion including MGMs and battery packs)
3. Upper canvas portion of harness
4. Velcro fasteners or straps with buckles
5. Two piece rigid plastic back support
6. Vertical hinge of two piece, rigid plastic back support
10. Hinge connecting MGM and battery pack
11. Rechargeable battery packs
12. Middle electric motor in the vertical motor arrangement of each MGM
13. Top electric motor in the vertical motor arrangement of each MGM
14. Bottom electric motor in the vertical arrangement of each MGM
17. Battery pack recharging receptacles
18. Harness seat flap
20. Motorized Gait Mechanism housing
21. Leg appendage track or guide on the bottom of each MGM
22. Leg appendage (fastened to "pie" gear)
24. Drive belt or chain
25. Pinion gear
27. Electric motor shaft
29. Outside lateral wall of MGM housing
44. Entry point on top of MGM housing for electric cord from crutches
62. Electric wire extending from MGM to crutches
68. Pinch rollers to keep drive chain or belt pressed against pinion gear
69. Pinch roller holders and drive chain belt or guides
70. Forty five degree, beveled, circular gear located in flank portion of MGMs between electric motors and gears
71. Large combination crown and standard circular gear. (The crown gear teeth are located on the inside of the gear towards the paraplegic. They are visible in FIG. H)
72. Pivot point of large combination crown and standard gear
73. Large "pie" gear with gear teeth on the inner portion of the circumference of the gear
74. Rubber bumper on forward rotating end of pie gear
75. Rubber bumper on backward rotating end of pie gear
76. "Stop Pad" mounted on inside of MGM housing to keep forward rotating end of pie gear from rotating too far forwards
77. "Stop Pad" mounted on inside of MGM housing to keep backward rotating end of pie gear from rotating too far backwards
78. Pivot point of "pie"gear
79. Solid inner portion of large circular combination standard/crown gear
80. Alternative MGM brake (either electrical or mechanical)
81. Space in large circular gear to allow it to rotate around pivot point of pie gear
82. Pinion gear between circular combination standard/crown gear and pie gear

CONCLUSION AND SCOPE

As there is a certain degree of coordination that needs to be achieved to become comfortable and competent with the use of the Paraplegic Controlled, Concealed Mechanized Walking Device, the paraplegic will need to practice. The standby assistance of two other people trained to assist people learning or relearning to how to ambulate, such as physical therapists, is advised. This is to teach and encourage, and catch and break the fall of the paraplegic to prevent injury, should he or she fall while practicing. The paraplegic should wear a gait belt at chest level for the people assisting him to grasp on to.

The paraplegic will need to wear rigid, plastic APA foot supports (#66, FIGS. 1 and 2) on both feet or another similar type of foot brace to prevent foot drop when using the mechanized walker.

Many paraplegics and incomplete quadriplegics loose vascular tone in their lower extremities with paralysis, which can cause them to have lower blood pressures. This can cause light-headedness. To compensate for this, should it occur, compression stockings or inflatable foot, calf or leg sleeves may need to be worn to keep blood from pooling in the legs when the paraplegic is standing upright.

For people that have a supra-pubic catheter that drains urine from the bladder out through the lower abdominal wall, the location of the battery packs on the upper abdominal area of the paraplegic will not infringe or obstruct the flow of urine. If necessary, a slit or opening can be made in the front portion of the harness seat flap to allow the catheter hose to pass through to the urine collection leg bag.

Due to the thickness of the MGM housings around the hips (approximately 1.5 inches) it is thought that for a more natural looking appearance, looser clothing should be worn including shirts that look appropriate worn untucked. The sides of the Motorized Gait Mechanisms should be narrow enough that they will not be noticed if a sweatshirt, sweater, suit jacket or regular jacket is worn.

The Paraplegic Concealed Mechanized Walking Device is also adaptable and suitable for paraplegics with amputated legs. Paraplegic/amputee patients with unilateral or bilateral leg amputations, either above the knee and/or below the knee will be able to benefit from the Paraplegic Controlled, Concealed Mechanized Walking Device. The leg appendages can be made to fit any size prosthesis.

It is also adaptable for people with one-sided leg paralysis such as those that have had a stroke by incorporating only one side of the walking device.

It is presumed that there will need to be at least three sizes of Mechanized Walking Devices to accommodate children, average size people and large people.

Although the above descriptions contains many specificities, these should not be construed as to limit the scope of the invention but to merely provide illustrations of some of the preferred embodiments of this invention.

GLOSSARY OF TERMS

Protective Garment: Two-piece (top and bottom) protective garment worn on the paraplegic's body under the Concealed Mechanized Walking Device to protect the skin. It would probably made of soft cotton Harness: Worn on the thoracic and abdominal part of the body. It has a right and a left side connected together in the back by a vertical hinge. It can be opened up in front to be put on or taken off. Each side consists of an upper section of canvas with a rigid plastic back support and a lower section consisting of a Motorized Gait Mechanism and a battery pack. The battery packs fasten to each other in front. It serves as the supporting mechanism for the upper body in relationship to the legs.

Motorized Gait Mechanism (MGM): A rigid plastic housing containing the electric motors and gears that work together to propel the leg appendages. Each MGM consists of four electric motors arranged horizontally, in a stacked formation, one above the other, conforming to the small of the paraplegic's back on both the right and left side. These motors drive a series of gears in the gearbox portion of the MGM along the side of the paraplegic. Fastened to the last gear in the gearing sequence is the leg appendage extending out of the bottom of the MGM down along the lateral part of the paraplegic's leg.

Battery packs: Two batteries that power the MGMs. Each is fastened by a hinge to the front of a MGM, one on the left and one on the right. They complete the front portion of the harness and have clasps on them to fasten to each other.

Inventor's Request for a Patent

The inventor is applying for a patent on the basic concept, layout and design of the walker. This patent request includes everything mentioned in the specification and drawings of this application. This includes the concept of two Motorized Gait Mechanisms, connected to each other by a vertical hinge in the back. Each MGM consists of a rigid housing that contains one or more electrical motors in back driving a series of gears placed at ninety degrees to the motors located along the sides. The MGM housings will have removable panels on the sides and backs or one large panel that can be opened or removed for assembly, adjustments or repairs. This concept also includes the battery packs, which complete the lower part of the harness, located in the front and having the clasps on them. This patent request also includes the leg appendages, knee hinge and brake details as well as the crutches, crutch handles and controls, flip down handles and controls and how all of the parts of the Paraplegic Controlled, Concealed Mechanized Walking Device fit together and work in relationship with each other. The inventor realizes that more information is needed, concerning exact details and specifications of the walker such as exact number of gears and gear ratios; strength, size and number of electric motors needed; crutch and crutch handle controls; brake details; and material specifications and tests that need to be performed, before a final product can be manufactured and marketed.

The inventor believes that the "Preferred Embodiment" MGM presented first in this application is the more desirable and efficient design in that the gears in it are simple circular gears as compared to the more complex gears in the "Alternative Embodiment" MGM design. Having the axis of all of the gears and electric motors parallel to each other, as presented in the "Description of the First Element of the Invention, Preferred Embodiment" is a more basic and simple design with less chance of mechanical failure that the more complex gears and circular beveled gears in the "Alternative Embodiment" MGM would present. But also included in this patent application is the request for the patent to include the "Alternative Embodiment" variation of the Motorized Gait Mechanism and how it integrates into the whole system.

I claim:

1. A mechanized walking device comprising:

a controller for controlling the mechanized walking device;

a harness to be worn around the torso, back and hip areas of the user, the harness including right and left side portions hingedly connected together in the back over the area of the spine, the right and left side portion are releasably fastened together in the front for securing the harness about the body of the user for putting on and taking off the mechanized walking device;

a motorized gait mechanism is attached to each of the right and left side portions of the harness, each motorized gait mechanism includes leg appendages extending down and out of the bottom thereof, the leg appendages adapted to be connected to the legs of the user, each motorized gait mechanism includes at least one motor and a series of gears connected to the leg appendages to provide oscillating, reciprocating, or rotating motion to the leg appendages, each motorized gait mechanism includes a brake to lock the motorized gait mechanism in place when not in operation;

the mechanized walking device includes battery packs that provide electrical power to drive the motors;

each leg appendage is comprised of an upper part and a lower part, the upper part extends down from the bottom of the motorized gait mechanism along the lateral part of the user's thigh to the knee, the lower part extends from the bottom end of the upper part, the lower part extends down the lateral part of the user's lower leg to above the ankle, a hinge connecting the upper and lower parts together, each leg appendage includes a knee brake located adjacent the hinge, the knee brake is controlled by the controller;

a pair of crutches to assist the user in walking, each crutch includes a handle, one crutch handle includes controls to control the motorized gait mechanism and knee brake on one side of the mechanized walking device and the other crutch handle includes controls to control the motorized gait mechanism and knee brake on the other side of the mechanized walking device;

each crutch includes an auxiliary handle for the user to grasp onto when in a sitting position, each auxiliary handle also has controls to control the motorized gait mechanism and knee brakes associated with that crutch, removable electric cords or a cordless arrangement connects the controls on the crutches to the motorized gait mechanism and knee brakes.

* * * * *